US006192610B1

(12) United States Patent
Fallon et al.

(10) Patent No.: US 6,192,610 B1
(45) **Date of Patent: *Feb. 27, 2001**

(54) LUMINOUS ELECTRIC SIGN

(75) Inventors: Timothy Ross Fallon, Boiling Springs; Walter Keisler Tanner, Jr., Chesnee, both of SC (US)

(73) Assignee: Fallon Luminous Products Corporation, Spartanburg, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/299,895

(22) Filed: Apr. 27, 1999

Related U.S. Application Data

(63) Continuation-in-part of application No. 08/819,821, filed on Mar. 18, 1997, now abandoned, which is a continuation-in-part of application No. 08/570,103, filed on Dec. 11, 1995, now abandoned, which is a continuation of application No. 08/262,007, filed on Jun. 17, 1994, now Pat. No. 5,533,286.

(51) Int. Cl.[7] ..... G09F 13/26

(52) U.S. Cl. ..... 40/545; 362/812

(58) Field of Search ..... 40/545, 564, 575, 40/580; 362/812

(56) References Cited

U.S. PATENT DOCUMENTS

| | | | | |
|---|---|---|---|---|
| 1,570,980 | | 1/1926 | Wiegand . | |
| 1,872,428 | | 8/1932 | Drury . | |
| 1,917,956 | | 7/1933 | Earley | 40/545 |
| 2,095,291 | | 10/1937 | Schneider | 40/545 |
| 2,302,667 | | 11/1942 | Duncan | 40/545 |
| 2,540,271 | * | 2/1951 | Lytton | 40/545 |
| 2,556,779 | | 6/1951 | Ross | 40/545 |
| 3,056,221 | | 10/1962 | Brienza | 40/545 |
| 3,300,885 | * | 1/1967 | Haire | 40/545 X |
| 4,201,003 | | 5/1980 | Witt | 40/545 |
| 4,829,691 | | 5/1989 | Manjos et al. | 40/661 |
| 5,186,566 | | 2/1993 | Cameron | 402/79 |
| 5,227,264 | * | 7/1993 | Duval et al. | 429/153 |
| 5,267,404 | | 12/1993 | Kizy | 40/545 |
| 5,529,173 | * | 6/1996 | Salacuse | 206/749 |
| 5,533,286 | | 7/1996 | Fallon et al. | 40/545 |
| 5,579,598 | | 12/1996 | Fallon et al. | 40/545 |

FOREIGN PATENT DOCUMENTS 403541 12/1933 (GB) .

* cited by examiner

*Primary Examiner*—Brian K. Green
(74) *Attorney, Agent, or Firm*—Hardaway/Mann IP Group

(57) ABSTRACT

A luminous electric display unit having glass tubing, filled with an inert gas, fully or partially enclosed within a protective housing, thereby providing protection both for the glass tubing and the public.

13 Claims, 11 Drawing Sheets

LUMINOUS ELECTRIC SIGN

CROSS REFERENCE TO RELATED APPLICATIONS

This application is a continuation-in-part of our U.S. patent application Ser. No. 08/819,821, filed Mar. 18, 1997, now abandoned which is a continuation-in-part of U.S. patent application Ser. No. 08/570,103, filed Dec. 11, 1995, now abandoned, which is a continuation of U.S. patent application Ser. No. 08/262,007, filed Jun. 17, 1994, now U.S. Pat. No. 5,533,286.

BACKGROUND OF THE INVENTION

1. Field of the Invention

The present invention relates generally to a luminous electric display unit of the inert gas-containing tube type. More particularly this invention is directed to a luminous electric display unit wherein the tube is partially protected with a transparent trough that is visible from all sides of the sign.

2. Description of Related Art

Luminous electric signs of the inert gas-filled tube type have long been employed in commercial and business establishments to provide decoration and/or impart information. Typically, such signs are referred to as "neon signs" and may be hung or placed in various locations, such as storefront windows, to advertise a product, decorate, or provide message information.

The tubular lighting elements of the sign may be conformed into an array of desired letters, logos, symbols, or decorative shapes, as in a glass tube-bending operation. The array is supportably attached by suitable brackets or wires to a rigid open frame, to a support backing, or to some form of housing or box.

In some situations, the housing that supports the lighting elements takes on special importance. For example, in applications such as food service, health care, schools, or any function involving children, safety is a primary consideration. When used in food service settings, the dust, foreign particles, and insects that tend to accumulate in neon signs become more than a mere nuisance, they may pose a contamination threat to food products in proximity. Luminous neon tube type signs, with their bright and varied colors, frequently draw the attention of children and can thus prove problematic because children are tempted to reach for the thin glass tubing. Moreover, governmental entities often place regulations on the use of luminous neon tube type signs in the above applications to guard against injury should the glass tubing break.

Security is another factor that retailers often consider when choosing a sign for advertising in and around their businesses. Many business owners want to maintain unobstructed sight lines to critical areas of their store or property to minimize opportunities for theft or other undesirable activity. Luminous neon tube type signs generally block the sight lines with their housing and thus are not used when unobstructed views are required.

As true of any product, manufacturing expense is always important. Housing for the components of a luminous neon tube type sign usually comes in multiple parts that must then be assembled. The additional assembly cost can add significantly to the manufacturing cost of the sign.

Various types of neon signs are known and found in the prior art. U. S. Pat. Nos. 1,570,980 to Wiegend, and 1,872,428 to Drury, show neon tube type signs where the glass tube is embedded in a groove to form the outline of a character or symbol. U. S. Pat. No. 5,267,404 to Kizy shows a neon tube type sign where the glass tube is mounted on a face plate that is in turn recessed within a rectangular housing. However, none of these signs completely cover the neon tube to protect the glass tubing from damage and to protect the public from injury. Kizy shelters the glass tube by placing the display unit within the housing, but the glass tube is still accessible from the front of the sign. U. S. Pat. No. 1,917,956 to Earley discloses a neon tube type sign where the glass tube is embedded in plaster and wax. While the plaster provides strong support for the tube, the front side of the tube is still exposed to the elements and thus may be soiled with insects, dust, and other foreign materials.

In addition, all of the above signs will block the sight lines wherever they are used and thus are not preferred where security is important.

None of the above signs use a single unit of material to totally encapsulate the glass tubing. Although Earley embeds the tubing in plaster and wax, the manufacturing process requires the plaster to be etched away in front of the tubing thus requiring a labor intensive step that defeats the benefits of complete encapsulation.

In view of the above, and in accordance with the present invention, it is desirable to provide a luminous electric display unit of the inert gas-filled tube type that protects both the glass tubing and the public from harm and keeps the glass tubing free from foreign debris. It is also desirable to provide a luminous electric display unit that is substantially transparent to allow for greater visibility of activities taking place in and around a place of business, for example. In addition, it is also desirable to reduce assembly expense by forming the housing from a single unit of material that encapsulates the glass tubing and is then sealed.

BRIEF SUMMARY OF THE INVENTION

Accordingly, one object of the present invention is to protect the lighting array of a luminous electric display unit of the inert gas-filled tube type from glass breakage and contamination by dust and foreign matter.

Another object is to protect the public from the dangers resulting from glass breakage or inappropriate handling of a luminous electric display unit.

Yet another object is to provide a luminous electric display unit that meets governmental regulations for use in food service or health care settings.

Still another object, in one form of the invention, is to provide a luminous electric display unit having a translucent housing thereby producing a substantially unobstructed view through the display unit.

An object of the present invention is to provide a luminous electric display unit wherein the illuminated tubing is visible from any angle of which the display unit is viewed.

And still further object, in one form of the invention, is to form the housing for the display unit from a single unit of material that is then molded to totally encapsulate and provide protection for the glass tubing held inside.

Also, another object of this invention is to provide a luminous electric display unit where the glass tube is not totally encapsulated and yet protected from environmental elements while remaining visible from all angles.

In accordance with another embodiment of the invention, both the face and back portions of the protective housing are made from a translucent material thereby minimizing any visual obstruction through the display unit.

In accordance with still another embodiment of the invention, the protective housing is made from a single unit of material that is then molded to encapsulate the glass tubing.

Further objects and advantages will become apparent from a consideration of the following description and drawings.

According to the present invention, the foregoing and other objects and advantages are attained by providing a luminous electric display unit having a protective housing that comprises a back portion and a face portion. The back portion has elongated grooves that are recessed from the face portion for receiving a gas filled glass tube. The face portion holds the glass tubing in place in the elongated grooves and also protects the tubing from damage or contamination by foreign debris. Electrical circuitry located behind the back portion of the housing illuminates the tubing when the circuitry is connected to a power source.

DETAILED DESCRIPTION OF THE INVENTION

Figure 1:
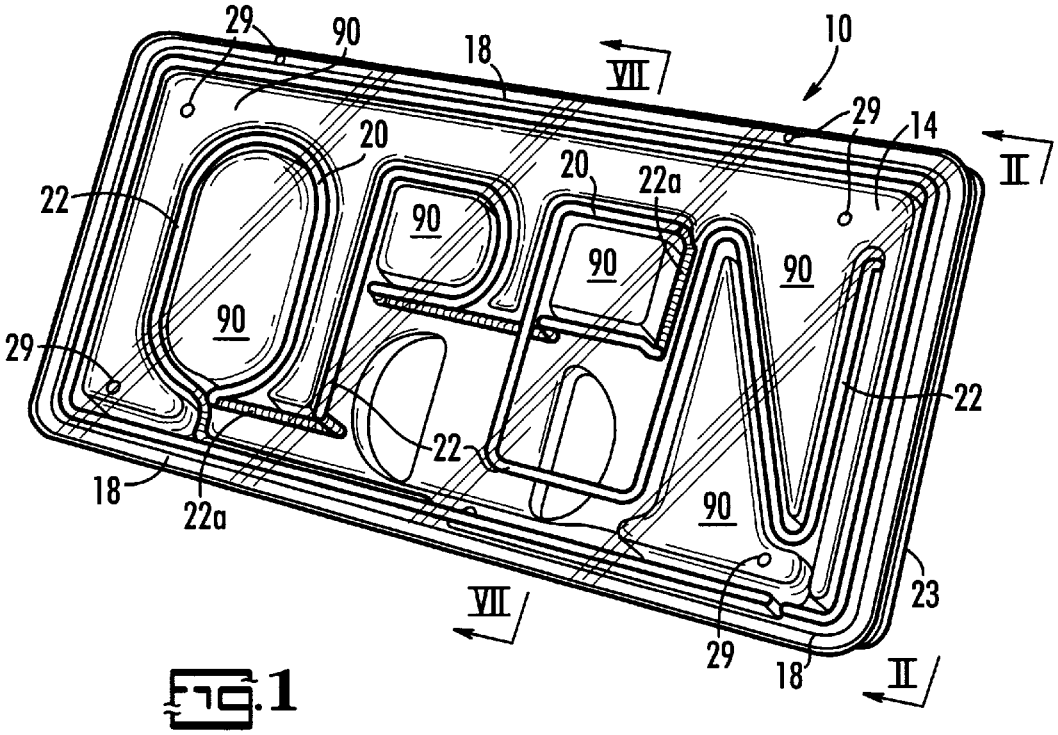
FIG. 1 is a front perspective view of a first embodiment of an electric luminous display unit of the present invention.

Referring now to the drawings, an improved luminous electric display unit that meets and achieves the various objects of the invention set forth above is shown.

As seen in FIGS. 1 through 4, electrical luminous display unit 10 includes support housing 12 having a substantially rigid face portion 14 and a substantially rigid back portion 16. Back portion 16 is preferably comprised of a thermoformable material while face portion 14 can be constructed from a less expensive material. Back portion 16 contains one or more elongated grooves 18, 20 for the receipt and protection of elongated glass tubing 22. The back portion 16 also has a lip 23 around the perimeter of said back portion for helping to maintain said face portion 14 in position when it is connected to the back portion 16. The face portion 14 also rests upon a shoulder 24 formed in the back portion 16. The shoulder 24 allows the front portion 14 to be adjacent to the back portion 16 when connected thus making any type of connection stronger and sturdier. Glass tubing 22 contains an inert gas, such as neon, that is electrically excited via transformer 28 and cables 26 to illuminate tubing 22. Tubing 22 forms the word "OPEN" surrounded by a generally rectangular border in the referred embodiment, however, any arrangements of letters can be formed and used in the display unit. To dissipate heat emanating from glass tubing 22 and transformer 28, back portion 16 contains vent holes 4 allowing cool air to enter the sign near the bottom and warm air to escape from the top of the sign.

Glass tubing 22 for containing the inert gas is bent, as in a heat-shaping operation. In such a shaping operation, a single length of tubing forms the entire word, e.g., OPEN, and the rectangular border. To separate and distinguish the letters, transition portions 22*a* of the length of tubing are, where practical, bent to lie primarily in a plane separate from the plane of the letters of the message to be conveyed (See FIGS. 1, 4 and 5). Transition portions 22*a* are also covered with an opaque coating to minimize the amount of light escaping from that portion of the tubing 22.

Figure 2:
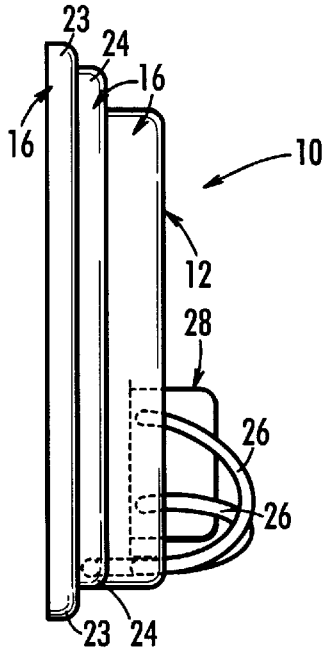
FIG. 2 is a right side elevation view of the display unit of FIG. 2 taken generally along lines II —II and looking in the direction of the arrows.
Figure 4:
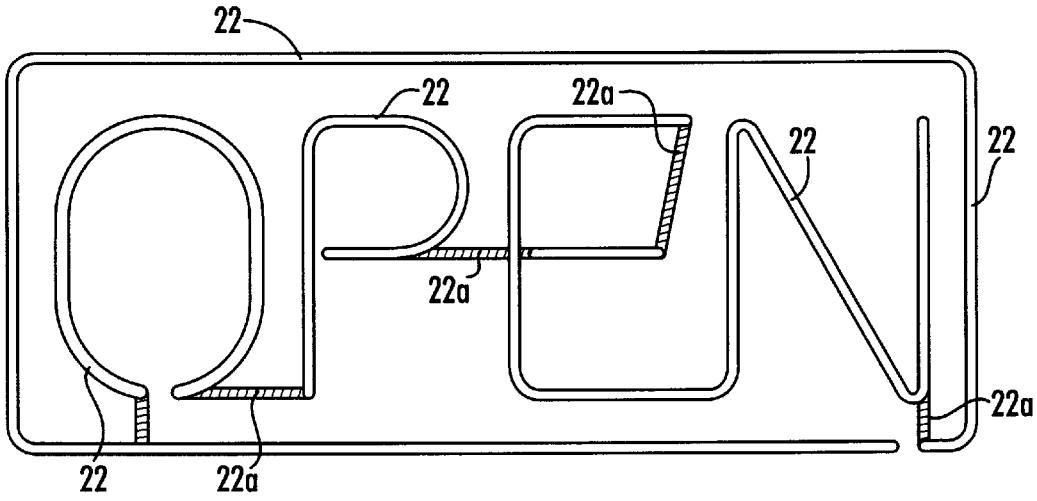
FIG. 4 is a front elevation view of the glass tubing of the luminous display unit of FIG. 1.
Figure 5:
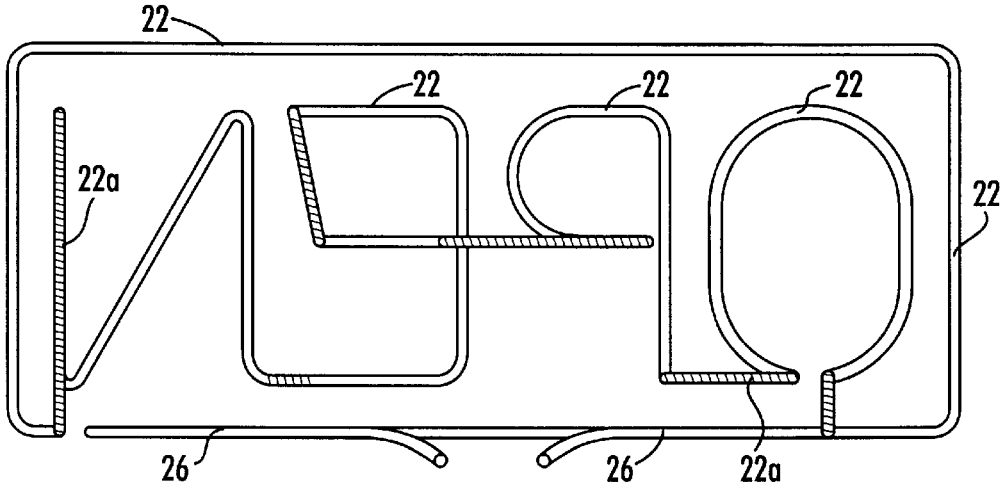
FIG. 5 is a rear elevation view of the glass tubing of the luminous display unit of FIG. 1.
Figure 6:
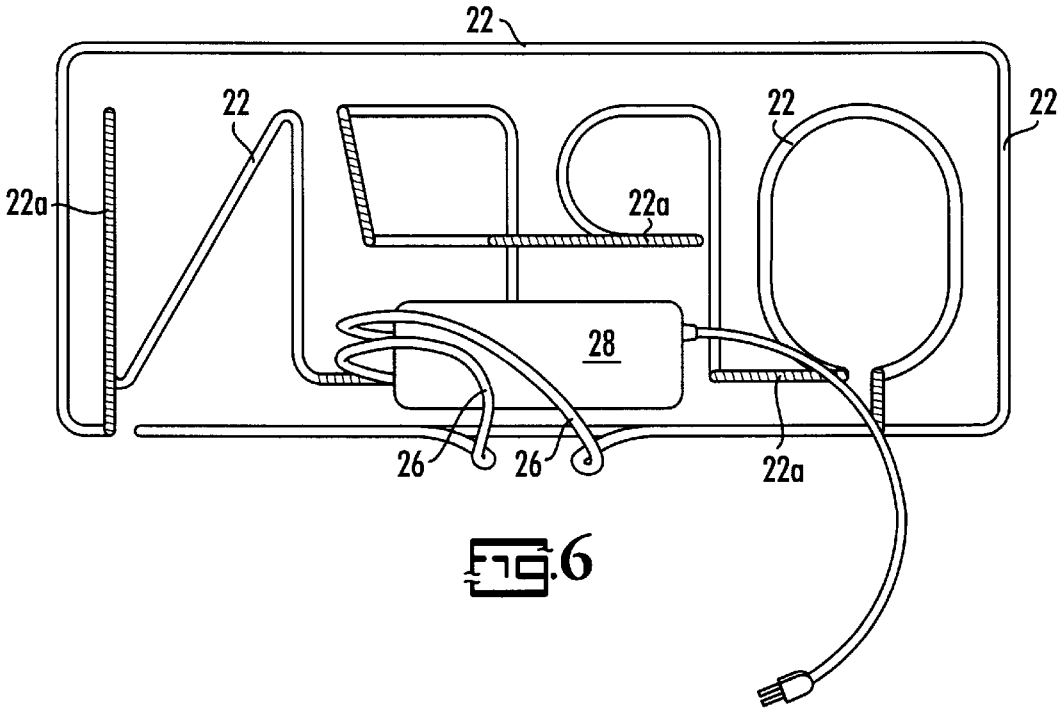
FIG. 6 is a rear elevation view of the glass tubing of the luminous display unit of FIG. 1 showing the connection of the electrical circuitry to the tubing.

As shown in FIGS. 2, 5 and 6, transformer 28 and cables 26 are used to deliver electrical power to display unit 10 from a conventional 120V AC power supply. Once energized, the gas illuminates the display unit 10 by transmitting light through the transparent portions of tubing 22. Transformer 28 is preferably positioned in an area of back portion 16 having no recessed grooves 20 (i.e., behind island 90 areas). This allows the overall width of the sign to be reduced to essentially the width of the transformer 28 plus the thickness of the materials comprising both face portion 14 and back portion 16 as shown best in FIG. 2. One clear advantage of reducing the overall sign thickness is that the sign can be hung against a wall instead of just from a ceiling. For maximum safety from electrical hazards, the transformer 28 could be encased in plastic such that the only component external to the housing 12 would be the power cord.

Figure 3:
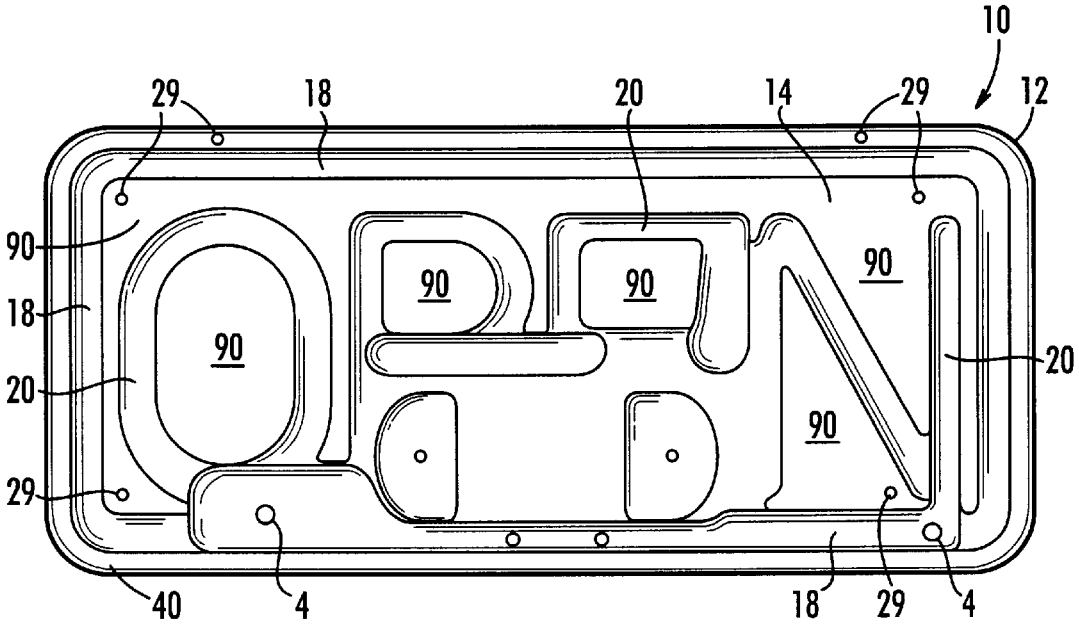
FIG. 3 is a front elevation view of the display unit of with the glass tubing removed to better show the grooves in the back portion of the unit, which receive and protect the tubing.
Figure 7:
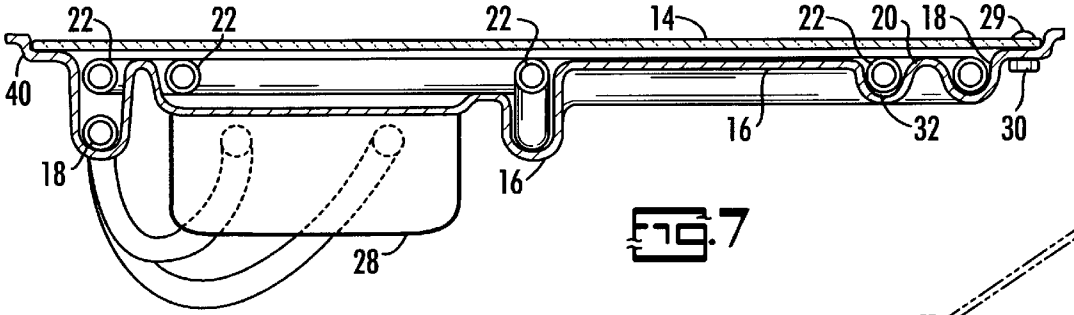
FIG. 7 is a sectional view of the display unit of FIG. 1, taken generally along lines VII—VII and looking in the direction of the arrows.
Figure 9:
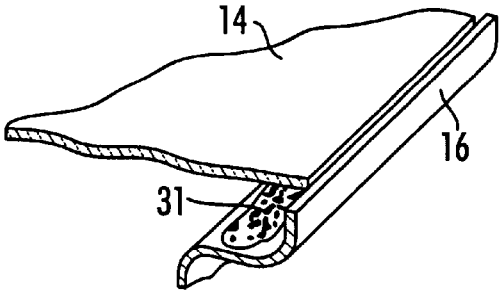
FIGS. 9 is a broken-away perspective view showing one technique for affixing the face portion of the unit to the back portion.
Figure 10:
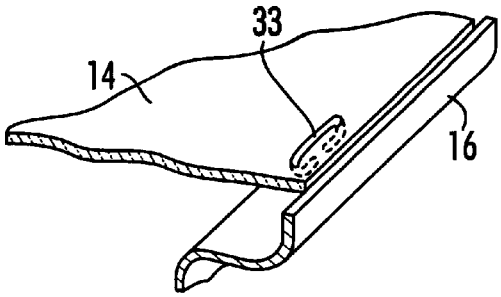
FIG. 10 is a broken-away perspective view showing a second technique for affixing the face portion of the unit to the back portion.
Figure 11:
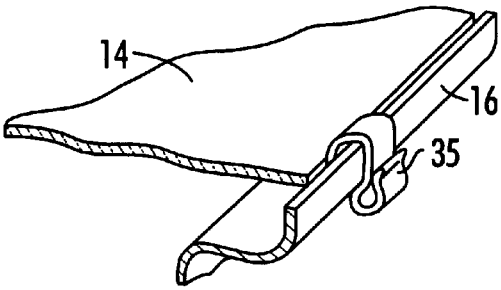
FIG. 11 is a broken-away perspective view showing a third technique for affixing the face portion of the unit to the back portion.
Figure 12:
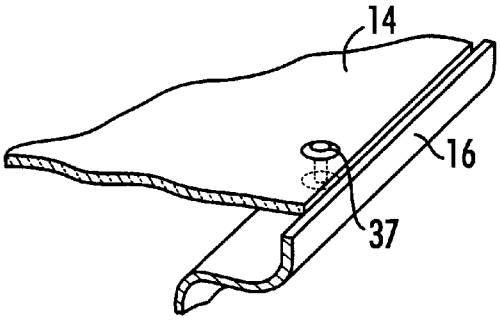
FIG. 12 is a broken-away perspective view showing a fourth technique for affixing the face portion of the unit to the back portion.

FIGS. 1, 3, and 7 show the encapsulation of glass tubing 22 within grooves 18, 20 and face portion 14. Glass tubing 22 is held in place by grooves 18, 20, face portion 14, and islands 90. Grooves 18, 20, face portion 14, and islands 90 combine to provide protection both for the tubing 22 and the public. Rubber bushings 32 are used to position glass tubing 22 in grooves 18, 20 to ensure a tight fit. Alternative means, such as plastic clips, or sponge cushioning could be used instead of rubber bushings 32.

Figure 13:
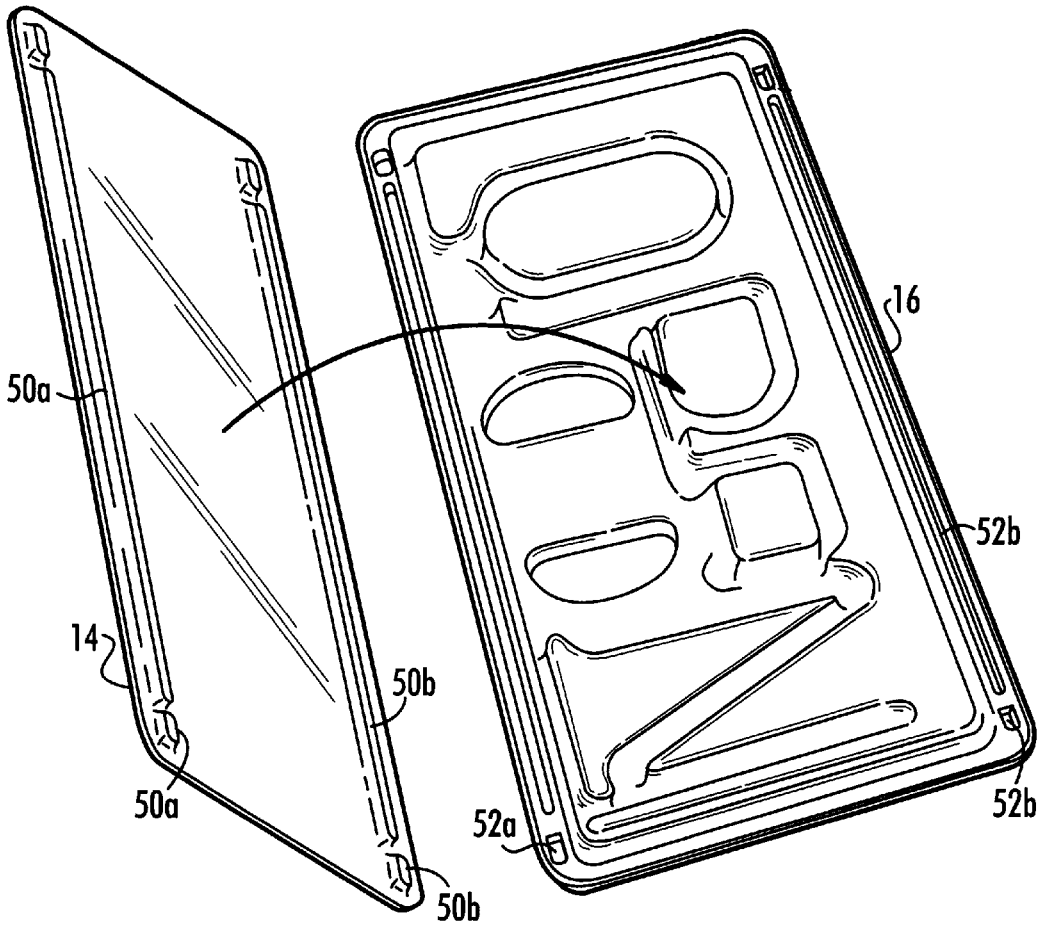
FIG. 13 is a perspective view showing a "blister pack" design for attaching the face and back portions to one another.

FIGS. 7 and 9 through 13 illustrate various mechanisms that can be used to secure the face portion 14 to the back portion 16. Face portion 14 is received into back portion 16 along lip 40 as shown in FIG. 7. Bolts 29 and nuts 30 are used to secure face portion 14 to back portion 16. In one common embodiment, face portion 14 is secured to back portion 16 via a "blister pack" seal (see FIG. 13). This technique requires raised regions 50*a,b* (i.e., blisters) that are dispersed about either face portion 14 (as shown in FIG. 13) or back portion 16 and extend towards the other portion. The raised regions 50*a,b* are exactly the same size and shape as their corresponding apertures 52*a,b*. Therefore, when the raised region 50*a,b* is inserted into the corresponding aperture 52*a,b,* the raised region 50*a,b* is squeezed slightly to fit within the corresponding aperture 52*a,b* forming a friction fit. The portions of the housing without the blisters or raised regions 50*a,b* have corresponding apertures 52*a,b* that are designed to receive blisters 50*a,b* and thus secure the two portions together via friction. The shape and position of blisters 50*a,b* and apertures 52*a,b* can be modified to suit the shape and contents of housing 12, so long as the blisters 50*a,b* correspond in size and shape to the apertures 52*a,b*. For example, a long narrow blister 50*a* and aperture 52*a* combination may be used along the edges of the display unit 10 while smaller, square shaped blisters 50*b* and apertures 52*b* may be used at the corners. Still another approach for attaching face portion 14 to back portion 16 involves forming lips 23 that extend from the edges of one or both portions. When the two portions are placed together, the lips 23 hook over an opposing edge or lip to ensure a secure fit. Other alternatives for securing face portion 14 to back portion 16 include: an adhesive 31 (FIG. 9), staples 33 (FIG. 10), clips 35 (FIG. 11), screws 37 (FIG. 12), heat melting, thermo-seal, ultrasonic welding, or other known securing means.

Face portion 14 is made from a translucent material. Back portion 16 is opaque for daylight applications and is preferably translucent for indoor, night time, or applications requiring an unobstructed view through the sign.

Figure 8:
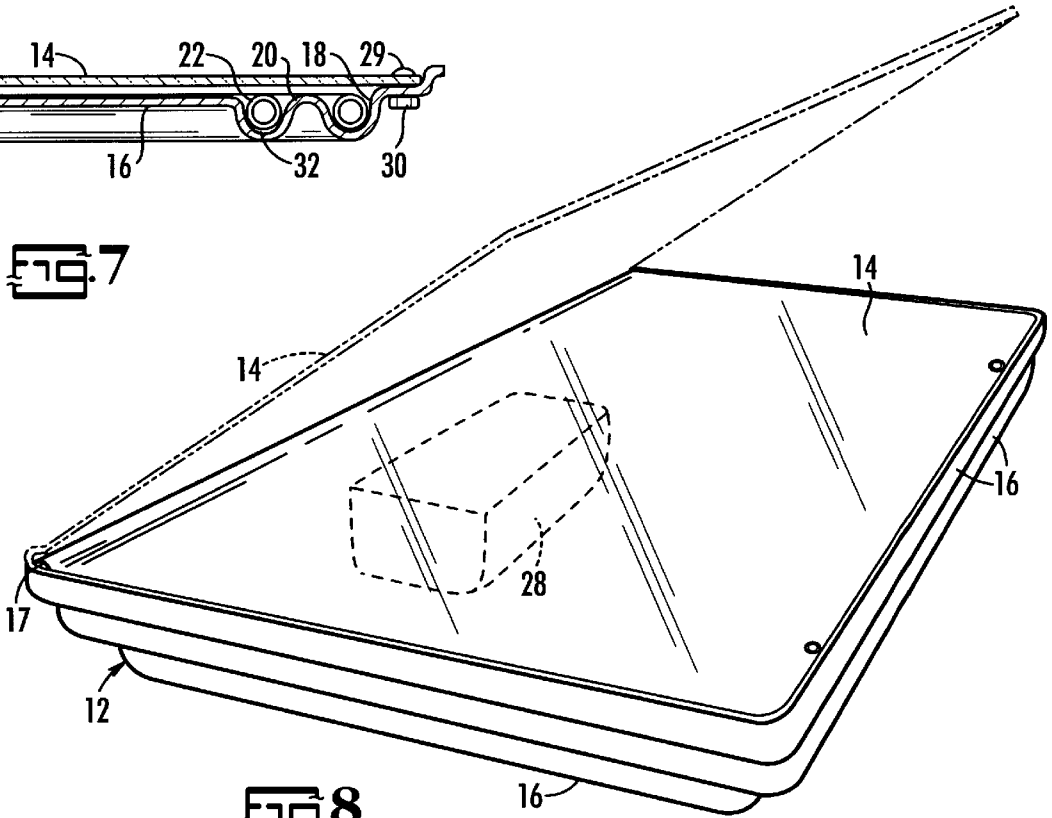
FIG. 8 is a right side perspective view of a second embodiment of the present invention showing the housing made of a single unit of material.

FIG. 8 shows yet another embodiment where a single piece of material is used to form both face portion 14 and back portion 16 of housing 12. In forming housing 12, back portion 16 should be comprised of a thermo-formable material. As part of the thermo-form process, a mold is impressed upon the heated material to form grooves 18, 20, which vary in depth, in back portion 16 (see FIG. 7). Deeper grooves 18, 20 are used to receive segments of transition portions 22*a* allowing those portions of tubing 22 to lie in a separate plane than the portions forming the letters. Face portion 14 is often comprised of a thin, pliable material that is relatively inexpensive. Since face portion 14 does not carry any load bearing responsibility, its composition and design is primarily dictated by the degree of protection required for tubing 22 and the public. Also, as shown in FIG. 8, the material is folded along flexible hinge 17 such that face portion 14 and back portion 16 oppose one another. Flexible hinge 17 is commonly a score line, but alternative embodiments are envisioned where separate hinge hardware is used to join face portion 14 to back portion 16. Face portion 14 and back portion 16 are then secured to each other using a blister pack seal 50*a,b* or any of the other means discussed above. By using a unitary piece of material to form the entire housing, manufacturing costs are reduced because fewer steps are required. For example, the housing is commonly placed on what is known in the industry as a "trim dye". Next, excess material is trimmed away to form the housing's shape and then holes and grooves are impressed upon the housing as desired. When a unitary piece of material is used to form the entire housing, these steps can be performed in one session on the dye. By contrast, multiple housing components each require their own session on the trim dye. In addition, a light weight, yet safe, display unit can be constructed by reducing the densities of face portion 14 and back portion 16 where appropriate.

Figure 14:
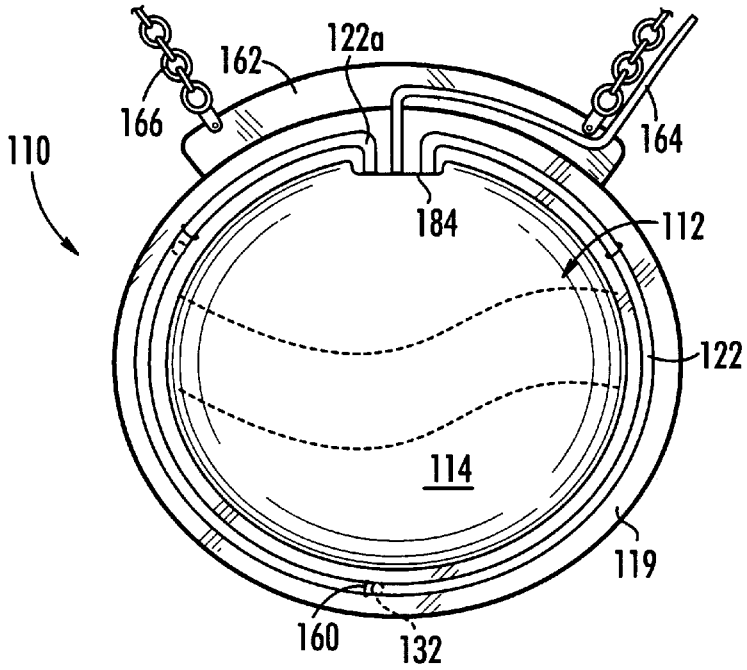
FIG. 14 is a front elevation view of a third embodiment of the electric luminous display unit.
Figure 15:
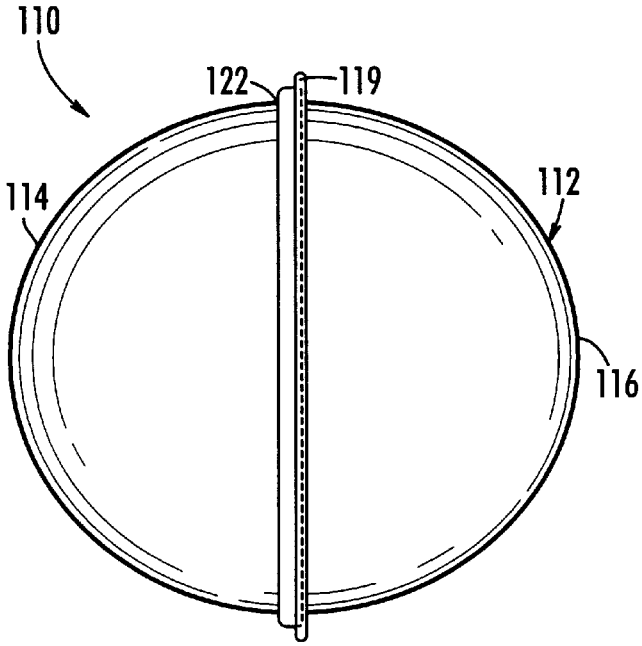
FIG. 15 is a bottom plan view thereof.
Figure 16:
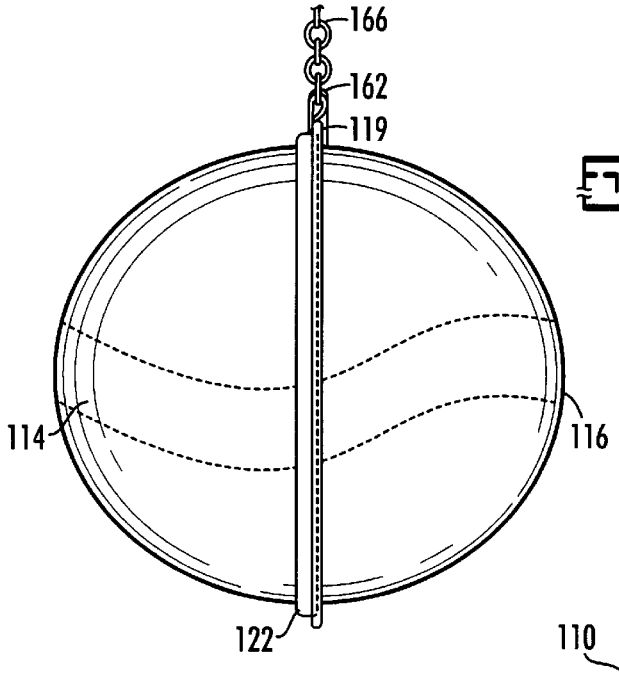
FIG. 16 is a side elevation view, the opposite side being a mirror image thereof.

FIGS. 14, 15 and 16 are directed toward the third embodiment in the electrical luminesce display unit 110. This third embodiment is comprised of a support housing 112 which has a front face portion 114 and a back portion 116. Along the perimeter of the support housing 112 is a trough 119 which holds a glass tubing 122. The trough 119 is connected to the back portion 116 and integrally formed therewith on one edge of the trough 119 such that one edge of the trough 119 is connected to the back portion 116 while the other edge of the trough 119 is not connected to any part of the housing 112, it just extends out away from the housing 112. A glass tubing 122 is held within the trough 19 by a retention wire 160 and at every location of a retention wire 160 there is also a bushing 132 placed between the glass tubing 122 and the trough 119 to prevent the glass tubing 122 from being damaged. At the top of the support housing 112 there is a hanger portion 162 formed therewith. This hanger portion 162 is integrally formed with the housing 112, either the front face portion 114 or the back portion 116. The hanger portion 162 allows the electric luminous display unit 110 to be hung from a support structure such as a ceiling or a wall. Connected to the hanger portion 162 are chains 166, or any other type of conventional hanging unit, that allow the electric luminous display unit 110 to be hung. Electrical circuitry is located within the housing 112 or between the back portion 116 and the front portion 114 of the housing 112. The electrical circuitry is connected to the glass tubing 122 and illuminates the glass tubing 122 when the circuitry is connected to a power source.

Figure 17:
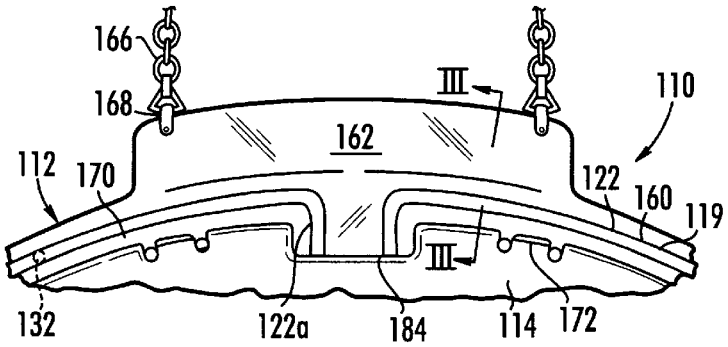
FIG. 17 is a partial blown-up front elevation view of the top portion of the electric luminous display unit.

FIG. 17 is a partial blown-up front elevation view of the top portion 114 of the electric luminous display unit 110. In this figure, chain elements 166 are connected to connecting means 168 which are connected to the hanger portion 162 allowing the electric luminous display unit 110 to be hung from a support structure. FIG. 17 more clearly discloses the trough element 119 that holds the glass tubing 122. The glass tubing 122 is held within the trough unit 119 by retention wire 160. Between the glass tubing 122 and the trough unit 119, a bushing 132 is placed to hold the glass tubing 122 firmly in place and prevent it from being damaged by the trough unit 119. Transition portions 122*a* of the glass tubing 122 are shown protruding out of the top of a tubing aperture 184 in the top part of the rigid faced portion 114. Also depicted in this figure is the flap element 170 and its relationship to the tongue element 172. The flap element 170 and the tongue element 172 are the means that connect the face portion 114 with the back portion 116, forming the entire support housing 112. The tongue element 172 has a slot located on each side thereof, and the flap 170 fits within the slots in such a manner that the tongue 172 and flap 170 are adjacent one another or nested together in a parallel fashion forming a locking mechanism.

Figure 18:
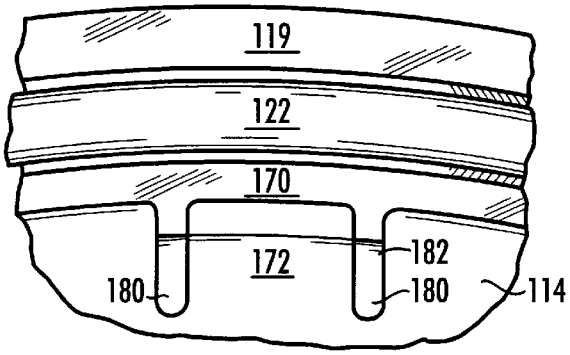
FIG. 18 is a broken-away partial view of the connecting means.
Figure 20:
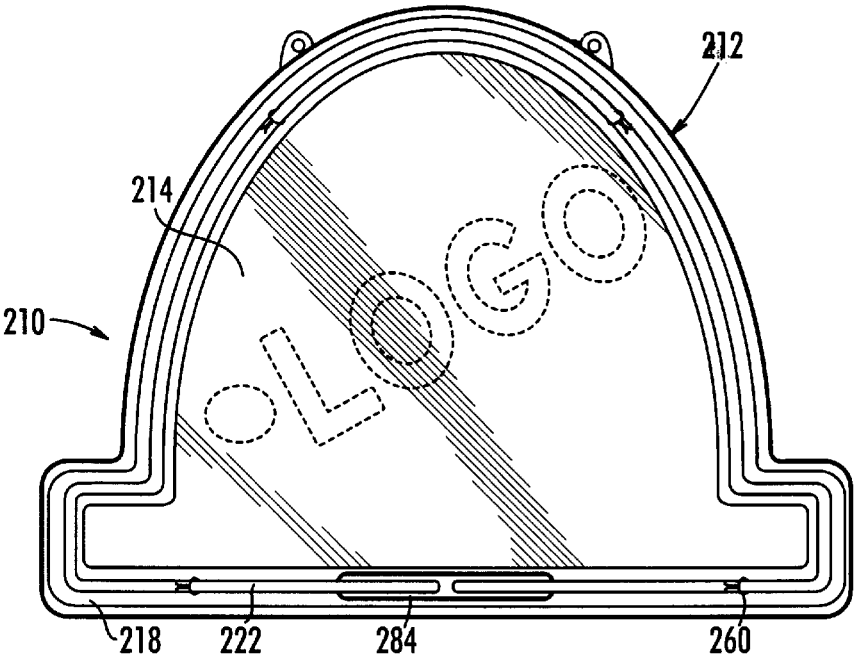
FIG. 20 is a front elevation of a fourth embodiment of the electric luminous display unit.
Figure 22:
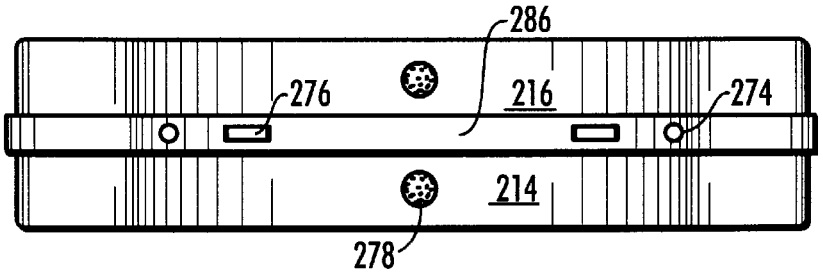
FIG. 22 is a top plan view of the fourth embodiment.
Figure 23:
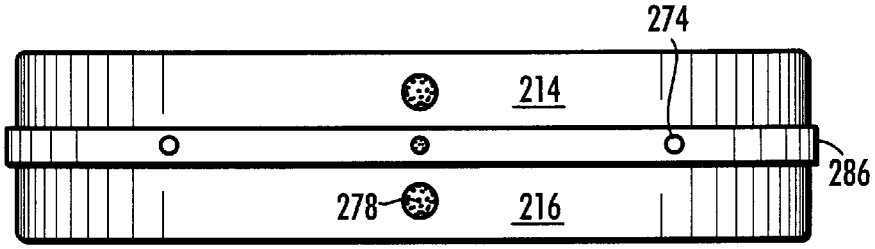
FIG. 23 is a bottom plan view of the fourth embodiment.
Figure 27:
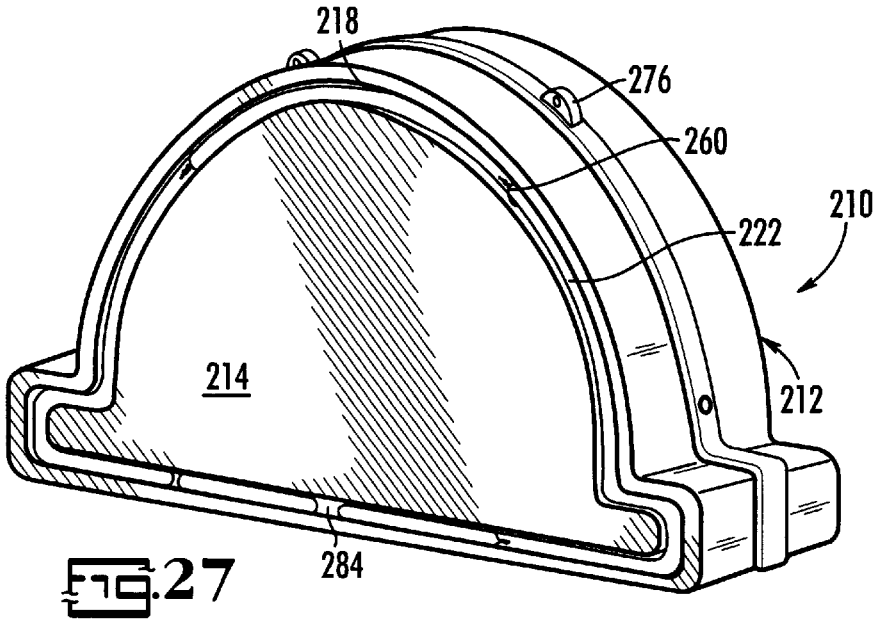
FIG. 27 is a front perspective view of the fourth embodiment of the electric luminous display unit.
Figure 21:
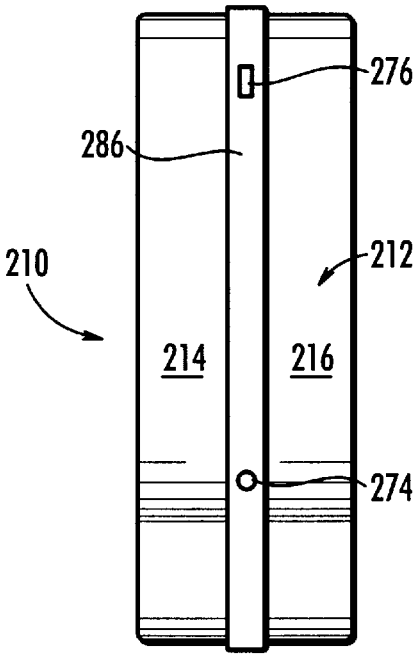
FIG. 21 is a side elevation view thereof, the opposite side being a mirror image.

FIG. 18 shows a broken-away partial view of the connection between the flap portion 170 and the tongue portion 172 as previously described. The inner edge of the trough portion 119, within which is held the glass tubing 122, forms the flap region 170 which overlaps with the tongue region 172 of the face portion 114. In the face portion 114, slots 180 are cut out forming the tongue portion 172. In the inner portion of the trough 119 which forms the flap 170, an aperture or apertures 182 are cut within the flap portion 170 to form an opening within which the tongue 172 is slid into forming, a tight friction formed connection means thereby connecting base portion 114 with the back portion 116.

Figure 19:
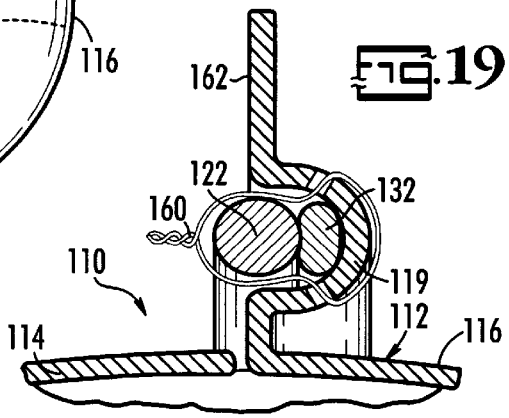
FIG. 19 is a cross-sectional view of the top portion of the electric luminous display unit taken along line III —III in FIG. 17.

FIG. 19 is a cross-sectional view of the top portion of the electric luminous display unit 110. In this figure the relationship between the front face portion 114 and the back portion 116 is more clearly depicted. Both the face portion 114 and the back portion 116 are preferably comprised as a thermo-formable material. The back portion 116 extends up into the trough portion 119, the trough portion 119 extends up into the hanger portion 162, and the hanger portion 162 is attached the chain 166 for hanging the entire electric luminous display unit 110. The glass tubing 122 is inset in the trough 119. The glass tubing 122 is held within the trough 119 by the retention wire 160. Located between the glass tubing 122 and the trough 119 is placed a bushing 132 to help hold the glass tubing 122 securely in place within the trough 119 and also to prevent it from moving and damage. As shown in this figure, the back portion 119, the trough 119 and the hanger portion 162 are all integrally formed and comprised of one continuous piece of thermoformable material. The trough 119 extends outside an exterior to the support housing 112. This allows the glass tubing 122 to be visible from any angle when the electric luminous display unit 110 is viewed.

FIGS. 20, 21, 22, 23 and 27 disclose the fourth embodiment of the electric luminous display unit 210. This fourth embodiment differs from the previous embodiments in that the glass tubing 222 is inlaid within groove 218 both on the face portion 214 as well as the rear portion 216 of the electric luminous display unit 210. The electric luminous display unit 210 again is comprised of a face portion 214 and a rear portion 216 of an overall support housing 212. The glass tubing 222 is retained within groove 218 by retention wire 260. The face portion 214 and the rear portion 216 of the support housing 212 are two separate pieces that are connected together along rim 286 that runs the perimeter of both the face portion 114 and the back portion 116, with the face portion rim (not shown) being placed inside the back portion rim 286 and connected together with connecting means 274. These connecting means can be any conventional type of connecting means such as screws, staples, bolts and the like. This fourth embodiment of the electric luminous display unit 210 can also be hung using hanging means 276. Located in both the top and the bottom of the support housing 212 and on both the face portion 214 and the rear portion 216 are located air vents 278. These vents 278 allow the air within the support housing 212 to enter and escape thus prevent the electric luminous display unit 210 from overheating.

Figure 24:
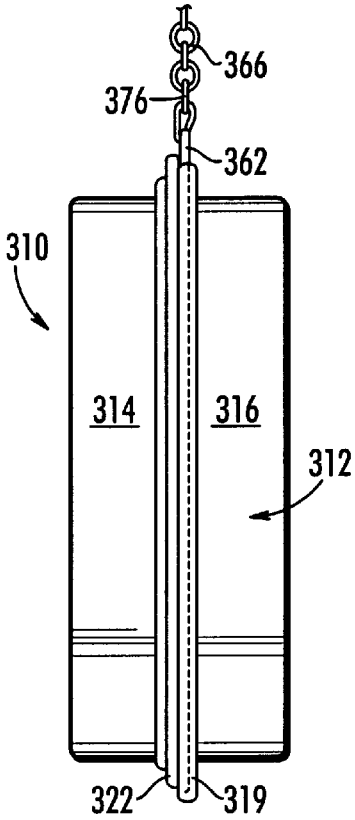
FIG. 24 is a side elevation view of a fifth embodiment of the electric luminous display unit.
Figure 28:
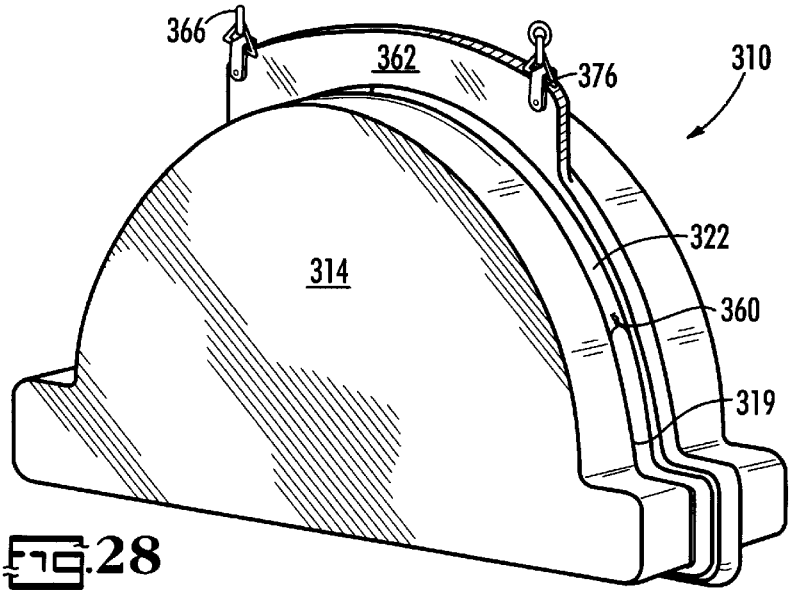
FIG. 28 is a front perspective view of the fifth embodiment of the electric luminous disply unit.
Figure 25:
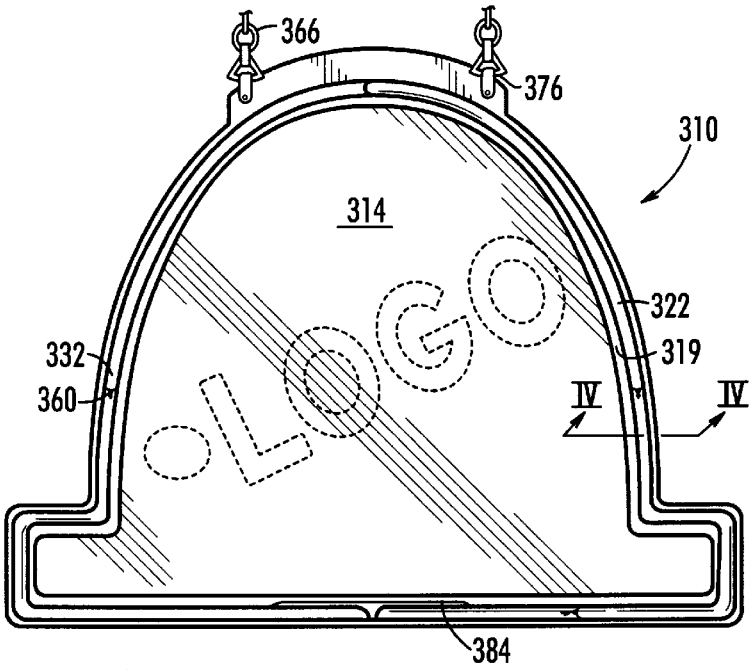
FIG. 25 is a front elevation view of the fifth embodiment thereof.

FIGS. 24, 25 and 28 depict a fifth embodiment of the electric luminous display unit 310. This fifth embodiment is similar to the third and fourth embodiments with the support housing 312 being comprised of a thermoformable material having two separate portions, one being the rigid face portion 314 and the other being the back portion 316. This embodiment also has a hanger portion 362 which has some type of conventional hanging means such as a chain 366 connected thereto with a connecting means 376. Around the perimeter of the support housing 312 is a trough 319 within which is housed a glass tubing 322. The glass tubing 322 is retained within the trough 319 by retention wires 360 and placed between the glass tubing 322 and the trough portion 319 are bushing elements 332 which help to hold the glass tubing 322 in place and prevent it from damage from the trough portion 319. The face portion 314 is connected to the rear portion 316 in the same manner or similar manner as in the fourth embodiment, that is, the rim (not shown) of the perimeter of the face portion 314 is inserted within the rim 386 of the back portion 316 and connected together with conventional connection means 374 such as screws, bolts, staples and the like. The difference between the fourth and the fifth embodiment is that in the fifth embodiment, the rim 386 of the rear portion 316 continues on and is integrally formed with the trough 319 which holds glass tubing 322.

Figure 26:
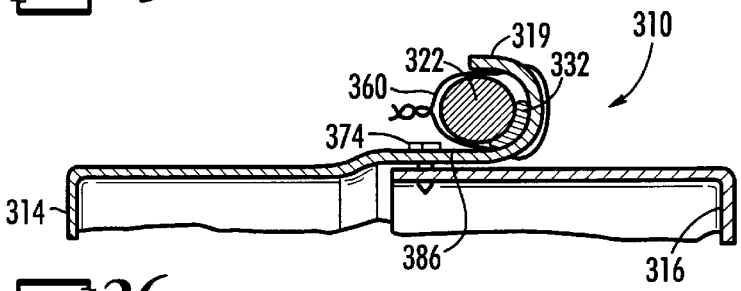
FIG. 26 is a cross-sectional view of the side of the electric luminous display unit taken along line IV—IV in FIG. 25.

FIG. 26 is a cross-sectional view of the side of the electric luminous display unit 310 showing the connection between the front face portion 314, the back portion 316 and the trough 319 that partially encapsulates the glass tubing 322. The front face portion 314 extends from the front of the electric luminous display unit 310 to the side where it forms a rim 386 and continues on in a curved fashion to form the trough 319 within which is placed the glass tubing 322. As in previously described embodiments, the glass tubing 322 is maintained within the trough 319 by retention wires 360 placed intermittently around the perimeter of the electric luminous display unit 310. Placed within the trough 319 and between it and the glass tubing 322 are bushings 332 to prevent the glass tubing 322 from hitting the surrounding trough 319 and becoming damaged or broken. The encompassing nature of the trough 319 protects the glass tubing 322 from breakage an vandalism as well as allows the glass tubing to be visible from various angles. While the face portion 314 and the back portion 316 may be either opaque, colored or transparent, the trough 319 itself is transparent, thus allowing for expanded visibility. However, if desired, the trough 319 can also be opaque or colored.

Thus it can be seen from the foregoing detailed description, that the present invention provides a safe, economical, luminous electrical display unit 310. Features such as total and partial encapsulation of the glass tubing 322, for the protection of both the tubing and the public, and a translucent housing 312 or the 322 tubing being located around the perimeter of the display unit 310 that provide an unobstructed view through the display unit 310, overcome many of the safety drawbacks found in prior art display units. Moreover, using a unitary piece of material, in a few of the embodiments, for the display unit housing 312 significantly reduces manufacturing costs.

While the above description contains many specificities, it is understood that many variations are apparent to one of ordinary skill in the art from a reading of the above specification. Such variations are within the spirit and scope of the present invention as defined by the following claims:

What is claimed is:

1. A luminous electric display unit for conveying visual information comprising:

a housing having a back portion having a perimeter and a translucent face portion, said back portion having elongated grooves therein recessed from said face portion and having a lip and a shoulder around said perimeter of said back portion;

inert gas-containing glass tubing positioned within said grooves between said back portion and said face portion;

electrical circuitry located behind said back portion and connected to said tubing for illumination of said tubing when said electrical circuitry is coupled to an external power source; and means for connecting said face portion to said back portion;

whereby said tubing is confined in said grooves by said face portion for protection of said tubing from undesired, foreign environmental factors.

2. The display unit of claim 1, wherein said means for connecting said face portion to said back portion is a plurality of bolts and a plurality of nuts.

3. The display unit of claim 1, wherein said means for connecting said face portion to said back portion is a thermo-seal.

4. The display unit of claim 1, wherein said means for connecting said face portion to said back portion is a blister pack, said blister pack having a raised region and a corresponding aperture, said raised region having the same size and shape as said corresponding aperture.

5. The display unit of claim 1, wherein said back portion is opaque.

6. The display unit of claim 1, wherein said back portion is translucent.

7. The display unit of claim 1, wherein said means for connecting said face portion to said back portion is a means for releasably connecting said face portion to said back portion.

8. A luminous electric display unit for conveying visual information comprising:

a housing comprised of a unitary piece of material; said housing having a back portion having a perimeter and a translucent face portion, said back portion having elongated grooves therein recessed from said face portion, a lip around said perimeter of said back portion and a rim portion adjacent said face portion when said face portion is connected to said back portion;

inert gas-containing glass tubing positioned within said grooves between said back portion and said face portion;

electrical circuitry located behind said back portion and connected to said tubing for illumination of said tubing when said electrical circuitry is coupled to an external power source;

an axis along which said unitary piece of material is folded thereby placing said face portion and said back portion in opposition to one another, and means for securing said face portion to said back portion;

whereby said tubing is confined in said grooves by said face portion for protection of said tubing from undesired, foreign environmental factors.

9. The display unit of claim 8, wherein said means for securing said face portion to said back portion is a plurality of bolts and a plurality of nuts.

10. The display unit of claim 8, wherein said means for securing said face portion to said back portion is a thermo-seal.

11. The display unit of claim 8, wherein said means for securing said face portion to said back portion is a blister pack, said blister pack comprising a raised region and a corresponding aperture, said raised region having the same size and shape as said corresponding aperture;

wherein when said raised region is inserted into said corresponding aperture, said raised region is squeezed slightly to form a friction fit.

12. The display unit of claim 8, wherein said back portion is opaque.

13. The display unit of claim 8, wherein said back portion is translucent.

* * * * *